United States Patent [19]

Nagano

[11] Patent Number: 4,565,959

[45] Date of Patent: Jan. 21, 1986

[54] CURRENT SUPPLY CIRCUIT WITH REDUNDANT BACK-UP CURRENT SOURCE

[75] Inventor: Katsumi Nagano, Shimonoseki, Japan

[73] Assignee: Tokyo Shibaura Denki Kabushiki Kaisha, Japan

[21] Appl. No.: 414,909

[22] Filed: Sep. 3, 1982

[30] Foreign Application Priority Data

Oct. 30, 1981 [JP] Japan ..... 56-173776

[51] Int. Cl.[4] ..... G05F 3/16

[52] U.S. Cl. ..... 323/315; 307/80; 307/297; 330/288

[58] Field of Search ..... 307/296 R, 297; 323/312, 313, 314, 315; 330/288

[56] References Cited

U.S. PATENT DOCUMENTS

| | | | |
|---|---|---|---|
| 3,002,105 | 8/1959 | Cady | 307/296 |
| 3,748,500 | 7/1973 | Tam | 307/297 |
| 3,751,685 | 8/1973 | Jaeger | 307/297 |
| 3,790,822 | 2/1974 | Giebler | 307/296 |
| 3,962,592 | 6/1976 | Thommen et al. | 307/297 |
| 4,325,017 | 4/1982 | Schade, Jr. | 323/313 |
| 4,396,883 | 8/1983 | Holloway et al. | 323/313 |
| 4,423,357 | 12/1983 | Engelman et al. | 307/297 |
| 4,437,023 | 3/1984 | Gill | 323/315 |
| 4,471,236 | 9/1984 | Patterson | 323/315 |

FOREIGN PATENT DOCUMENTS

| | | | |
|---|---|---|---|
| 0203114 | 12/1982 | Japan | 323/315 |

OTHER PUBLICATIONS

Ottesen, IBM Technical Disclosure Bulletin, vol. 7, #10; Mar. 1965.

Russell et al., "Automotive and Industrial Electronic Building Blocks", IEEE Journal of Solid-State Circuits, vol. SC-7, No. 6 (Dec. 1972), at pp. 446–454.

*Primary Examiner*—William H. Beha, Jr.

*Assistant Examiner*—Jeffrey Sterrett

*Attorney, Agent, or Firm*—Finnegan, Henderson, Farabow, Garrett & Dunner

[57] ABSTRACT

A current supply circuit comprised of a first and a second current mirror circuit. The current supply circuit is provided with a control circuit which, at the time when the first current mirror circuit is in operation, renders the second current mirror circuit inoperative and, at the time when the first current mirror circuit is out of operation, renders the second current mirror circuit operative.

5 Claims, 2 Drawing Figures

CURRENT SUPPLY CIRCUIT WITH REDUNDANT BACK-UP CURRENT SOURCE

BACKGROUND OF THE INVENTION

This invention relates to a current supply circuit having the capability of supplying a current.

In a bipolar linear IC, a current source circuit is often employed. This current source circuit is shown, for example, in FIG. 8 of "Automotive and Industrial Electronic Building Blocks" by Ronald W. Russell and Thomas M. Frederiksen, IEEE, J. of Solid-State Circuits, Vol. SC-7, No. 6, pp. 446–454, Dec. 1972. The conventional current source circuit, however, has the drawback that it no longer operates when the supply of a current to it from a current input means ceases.

SUMMARY OF THE INVENTION

The object of the invention is to provide a current supply circuit with a low probability of cessation of current output.

To achieve the objects and in accordance with the purpose of the invention, as embodied and broadly described herein, the current supply circuit according to the invention has first and second power source terminals; a plurality of output terminals; a first current mirror circuit including a first input transistor whose current path is connected between said first and second power source terminals, and a plurality of output transistors whose current paths are connected between said first power source terminal and said plurality of output terminals and whose bases are connected to the base of said first input transistor; a second current mirror circuit including a second input transistor whose current path is connected between said first and second power source terminals, and a plurality of output transistors whose current paths are connected between said first power source terminal and said plurality of output terminals and whose bases are connected to the base of said second input transistor; first input current setting means connected to said first input transistor for limiting current flowing through said first input transistor; second input current setting means connected to said second input transistor for limiting current flowing through said second input transistor; and control means connected to said first and second current mirror circuits for detecting a current flowing through said first input transistor, and supplying a first control signal to said second input transistor to set said second input transistor into an inoperative state when it is detected that a current is flowing through said first input transistor, and for supplying a second control signal to said second input transistor to set said second input transistor into an operative state when it is detected that a current is not flowing through said first input transistor.

BRIEF DESCRIPTION OF THE DRAWINGS

Other objects and advantages will become apparent from the following description taken in conjunction with the accompanying drawings, in which.

DETAILED DESCRIPTION OF THE PREFERRED EMBODIMENT

Figure 1:
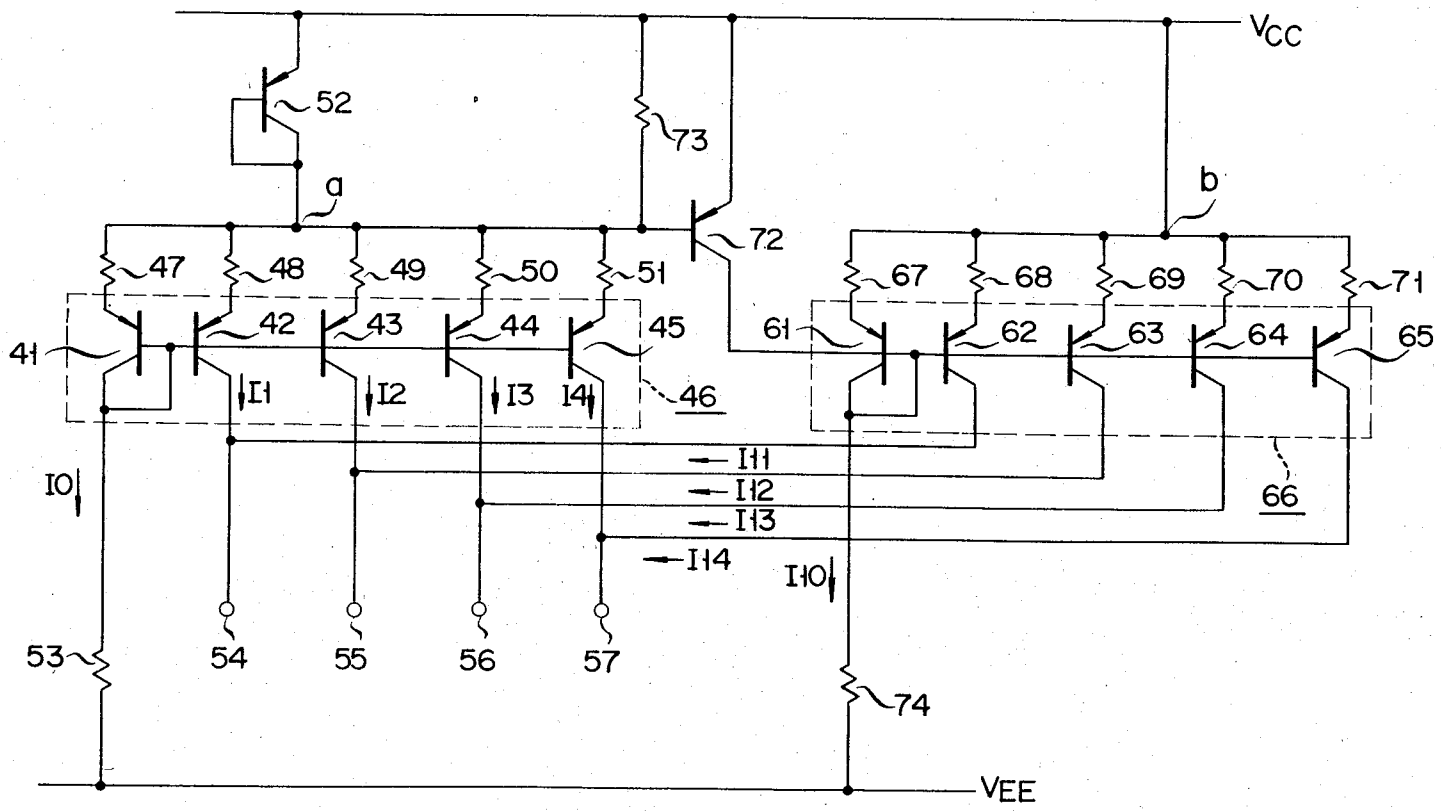
FIG. 1 is a circuit diagram of a current supply circuit according to the preferred embodiment of the invention.

A current supply circuit according to an embodiment of the invention will now be described with reference to FIG. 1. The current supply circuit has a first current mirror circuit 46 comprised of five pnp transistors 41 to 45 and a second current mirror circuit 66 comprised of five pnp transistors 61 to 65. The bases of the transistors 41 to 45 are commonly connected, and the emitters thereof are connected to emitter resistors 47 to 51 at one end thereof, respectively. The base of the transistor 41 is connected to the collector of the same. The other ends of the emitter resistors 47 to 51 are connected commonly, and a point a of this common connection is connected to a high potential application point $V_{CC}$ through a collector-emitter path of a pnp transistor 52. The base of the transistor 52 is connected to the collector thereof. The collector of the transistor 41 is connected to a low potential application point $V_{EE}$ through a resistor 53. The resistor 53 functions to set an input current value with respect to the first current mirror circuit 46. The collectors of the four transistors 42 to 45 are connected to current output terminals 54 to 57, respectively.

The bases of the transistors 61 to 65 are commonly connected, and the emitters thereof are connected to emitter resistors 67 to 71 at one end thereof, respectively. The base of the transistor 61 is connected to the collector of the same. The other ends of the emitter resistors 67 to 71 are commonly connected to a point b and are connected to the high potential application point $V_{CC}$. The point of common connection of the bases of the pnp transistors 61 to 65 is connected to the collector of a pnp transistor 72. The base of the pnp transistor 72 is connected to the point a of common connection of said other ends of the emitter resistors 47 to 51 and, also, is connected to the high potential application point $V_{CC}$ through a resistor 73. The emitter of the transistor 72 is connected directly to the high potential application point $V_{CC}$. The collector of the pnp transistor 61 is connected to the low potential application point $V_{EE}$ through a resistor 74. The resistor 74 functions to set an input current value with respect to the second current mirror circuit 66. The collectors of the four pnp transistors 62 to 65 are connected to the above-mentioned current output terminals 54 to 57, respectively.

A circuit comprising the pnp transistors 52, 72 and the resistor 73 functions to control the second current mirror circuit 66. When a current is allowed to flow in the first current mirror circuit 46, this control circuit renders the second current mirror circuit nonconductive and, when the flow of a current into the first current mirror circuit is not detected, renders the second current mirror circuit 66 operative.

When an input current Io is allowed to flow in the first current mirror circuit 46 through the resistor 53, the pnp transistors 41 to 45 are each made operative. And from the current output terminals 54 to 57 are output the currents I1 to I4 having the relationship:

$$RoIo - RiIi + V_T \ln \frac{Io}{Ii} = 0 \quad (1)$$

where Ro represents the resistance value of the emitter resistor 47, Ri (i=1 to 4) the resistance value of each of the emitter resistors 48 to 51, and $V_T$ the thermal voltage. For example, the currents I1 and I3 are set to 10 μA, and the currents I2 and I4 are set to 100 μA. In this case, the current $$\left(Io + \sum_{i=1}^{4} Ii\right)$$

equal to a sum of the collector currents of the five pnp transistors 41 to 45 constituting the first current mirror circuit 46 is allowed to flow in the transistor 52. And the collector voltage of the pnp transistor 52 is lower than the voltage $V_{CC}$ of the high potential application point by the base-emitter voltage $V_{BE}$ of the transistor 52. Further, the emitter voltage of the pnp transistor 72 is the voltage $V_{CC}$ of the high potential application point and the base voltage thereof is lower than this voltage $V_{CC}$ by the base-emitter voltage $V_{BE}$ of the pnp transistor 52. Accordingly, the pnp transistor 72 is turned "on" with a result that the collector voltage thereof becomes substantially equal to the voltage of the high potential application point $V_{CC}$.

In the second current mirror circuit 66, the emitter voltage of each of the pnp transistors 61 to 65 is also equal to the voltage $V_{CC}$ of the high potential application point. Accordingly, the base-emitter voltage $V_{BE}$ of each of the pnp transistors 61 to 65 is substantially zero in level. As a result, the pnp transistors 61 to 65 are kept "off". That is, the second current mirror circuit 66 is made inoperative. At this time, the collector current of the transistor 72 is determined by the resistor 74. In this case, the currents I1 to I4 from the first current mirror circuit 46 are output from the current output terminals 54 to 57.

If the current IO ceases to flow in the transistor 41 for some reason such as a failure of the resistor 53, a breakage of the wiring, or a failure of a contact connecting the resistor 53 and the wiring, no current will flow in the pnp transistors 42 to 45 constituting the first current mirror circuit 46. In this case, no current flows in the pnp transistor 52 with the result that the voltage drop in the same becomes zero. The base voltage of the pnp transistor 72 is set to the voltage $V_{CC}$ of the high potential application point by the operation of the resistor 73. The base-emitter voltage of the pnp transistor 72 becomes zero in level. Thus, the transistor 72 is brought to an "off" state. Since the bases of the pnp transistors 61 to 65 of the second current mirror circuit 66 are each cut off from the high potential application point, input current is allowed to flow in the second current mirror circuit 66 through the resistor 74.

When the current flowing through the resistor 74 is represented by I10, the resistance value of the emitter resistor 67 by R10, the resistance value of each of the emitter resistors 68 to 71 by Rn (n=11 to 14), and the collector current of each of the pnp transistors 62 to 65 by In, the relation between I10 and In is given by the following equation.

$$R10I10 - RnIn + V_T \ln \frac{I10}{In} = 0 \qquad (2)$$

When the resistor 74 and the emitter resistors 67 to 71 are set to predetermined resistance value, respectively, the amounts of current I11 to I14 equal to the above-mentioned amounts of current I1 to I4, respectively, are output from the second current mirror circuit 66 through the terminals 54 to 57, respectively.

Figure 2:
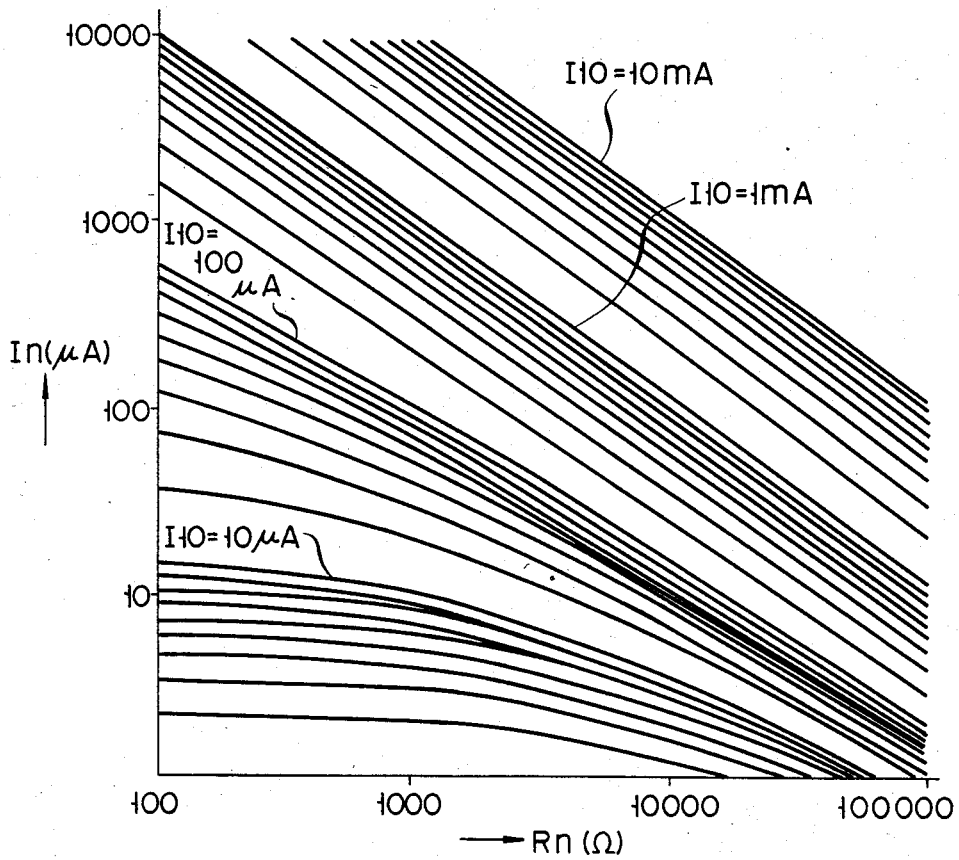
FIG. 2 is a graph showing the relationship between the emitter resistance Rn and the output current In of the current supply circuit.

FIG. 2 shows the relation of the current In (n=11 to 14) with respect to the emitter resistance Rn (n=11 to 14) established when the resistance value R10 of the emitter resistor 67 is set at 1 kΩ and the current I10 flowing in the second current mirror circuit through the resistor 74 is used as a parameter. To make the current consumption of the whole circuit small, the current I10 is preferably set at a value equal to half of the current Io flowing in the first current mirror circuit 46. When a current I10 of 50 μA is desired to flow in the second current mirror circuit with the resistance value of the resistor 67 set at 1 kΩ, the emitter resistance may be set so that R11=R13=9 kΩ and that R12=R14=310 Ω. As a result, I11=I13=10 μA and I12=I14=100 μA.

According to the above-mentioned embodiment, even when the input current to the first current mirror circuit is interrupted with a result that no current is output from the same, it is possible to render the second current mirror circuit operative to cause a current to be output from this circuit. Thus, the probability with which a current ceases to be output from the present current supply current becomes lower than in the prior art. Thus, an IC using this current supply circuit has enhanced reliability.

The present invention is not limited to the above-mentioned embodiment. For example, the input currents Io and I10 to the first and second current mirror circuits 46 and 66 may be so arranged as to be set by current sources in lieu of being set by the resistors 53 and 74.

What is claimed is:

1. A current supply circuit comprising:

first and second power source terminals;

a plurality of output terminals;

a first current mirror circuit including a first input transistor whose current path is connected between said first and second power source terminals, and a plurality of output transistors whose current paths are connected between said first power source terminal and said plurality of output terminals and whose bases are connected to the base of said first input transistor;

a second current mirror circuit including a second input transistor whose current path is connected between said first and second power source terminals, and a plurality of output transistors whose current paths are connected between said first power source terminal and said plurality of output terminals and whose bases are connected to the base of said second input transistor;

first input current setting means connected to said first input transistor for limiting current flowing through said first input transistor;

second input current setting means connected to said second input transistor for limiting current flowing through said second input transistor;

a plurality of first resistance means connected respectively between said first power source terminal and said plurality of output transistors constituting said first current mirror circuit;

a plurality of second resistance means connected respectively between said second power source terminal and said plurality of output transistors constituting said second current mirror circuit; and control means for detecting current flowing through said first input transistor, and supplying a first control signal to said second input transistor to set said second input transistor into an inoperative state when it is detected that a current is flowing through said first input transistor, and for supplying a second control signal to said second input transistor to set said second input transistor into an operative state when it is detected that a current is not flowing through said first input transistor, said control means including a control transistor having an emitter connected to said first power source terminal, a collector connected to the base of said second input transistor, and a base connected to said second power source terminal through the current path of said first input transistor.

2. The current supply circuit according to claim 1, further comprising a transistor whose emitter is connected to said first power source terminal and whose base and collector are connected to said second power source terminal through the current path of said first input transistor.

3. The current supply circuit according to claim 1, wherein said first and second input current setting means are each a resistance.

4. The current supply circuit according to claim 1, further comprising third resistance means connected between the emitter and base of said control transistor.

5. The current supply circuit according to claim 4, further comprising a transistor whose emitter is connected to said first power source terminal and whose base and collector are connected to said second power source terminal through the current path of said first input transistor.

* * * * *